US005651280A

United States Patent [19]

Park

[11] Patent Number: 5,651,280

[45] Date of Patent: Jul. 29, 1997

[54] DOOR LOCK

[75] Inventor: Jung Woo Park, Suseong-Gu, Rep. of Korea

[73] Assignee: Dusan Metals, Inc., Taegu, Rep. of Korea

[21] Appl. No.: 701,908

[22] Filed: May 20, 1996

[30] Foreign Application Priority Data

Sep. 13, 1995 [KR] Rep. of Korea ..... 95-30303

[51] Int. Cl.[6] ..... E05B 13/10

[52] U.S. Cl. ..... 70/472; 70/149; 70/223; 70/224; 70/422

[58] Field of Search ..... 70/204, 188, 189, 70/422, 472, 149, 218, 221–224; 292/359, DIG. 27

[56] References Cited

U.S. PATENT DOCUMENTS

| | | | |
|---|---|---|---|
| 1,516,152 | 11/1924 | Dumont | 70/422 |
| 2,497,328 | 2/1950 | Smith et al. | 70/149 |
| 2,729,090 | 1/1956 | Floraday | 70/223 |
| 3,922,896 | 12/1975 | Kagoura | 70/149 X |
| 4,773,240 | 9/1988 | Foshee | 70/422 X |
| 5,040,391 | 8/1991 | Lin | 70/472 X |
| 5,040,652 | 8/1991 | Fish et al. | 70/422 X |
| 5,263,348 | 11/1993 | Wittwer | 70/422 X |
| 5,447,047 | 9/1995 | Lin | 70/472 X |

*Primary Examiner*—Lloyd A. Gall
*Attorney, Agent, or Firm*—Schmeiser, Olsen & Watts

[57] ABSTRACT

An improved door lock is disclosed whereby the application of excessive force on the door handle will not cause a malfunction of the door lock and will not cause damage to the internal working features of the door lock. The door lock includes an outer rose spindle assembly, having an inner and an outer spindle, wherein the two spindle portions are releasably connected by a plurality of complementary pins and dints. Upon the application of excessive force on the door handle, the pins are released from the dints such that the force is not further transmitted to sequential features of the lock body.

2 Claims, 3 Drawing Sheets

DOOR LOCK

FIELD OF THE INVENTION

This invention relates generally to locks, and more particularly, to an improved door lock mechanism designed to protect the inner working features, or lock body, from damage due to exertion of excessive force on the external door lever.

BACKGROUND OF THE INVENTION

Frequently, damage can be done to the inner working features, or lock body, of a door lock upon the exertion of excessive force on the external door lever/handle. The damage can often be severe and require expensive repairs or even replacement of the entire door lock. Moreover, applying excessive force to the lever/handle can cause a malfunction of the lock, thereby allowing the door to be opened, when in fact, it is intended to be locked.

It is therefore desirable to provide a new door lock mechanism which is capable of protecting the inner lock body of a door lock from excessive force that may be applied to the door lever/handle.

SUMMARY OF THE INVENTION

It is an object of the present invention to provide a new door lock mechanism which prevents excessive force, that may be applied to the door handle, from being transmitted to the inner working features of the lock body.

It is another object of the present invention to provide a new door lock mechanism that is capable of protecting the inner lock body from malfunction due to the exertion of excessive force on the external lock handle.

It is a further object of the present invention to provide a door lock mechanism having a divided outer rose spindle and key connecting members.

DETAILED DESCRIPTION OF THE DRAWINGS

Figure 1:
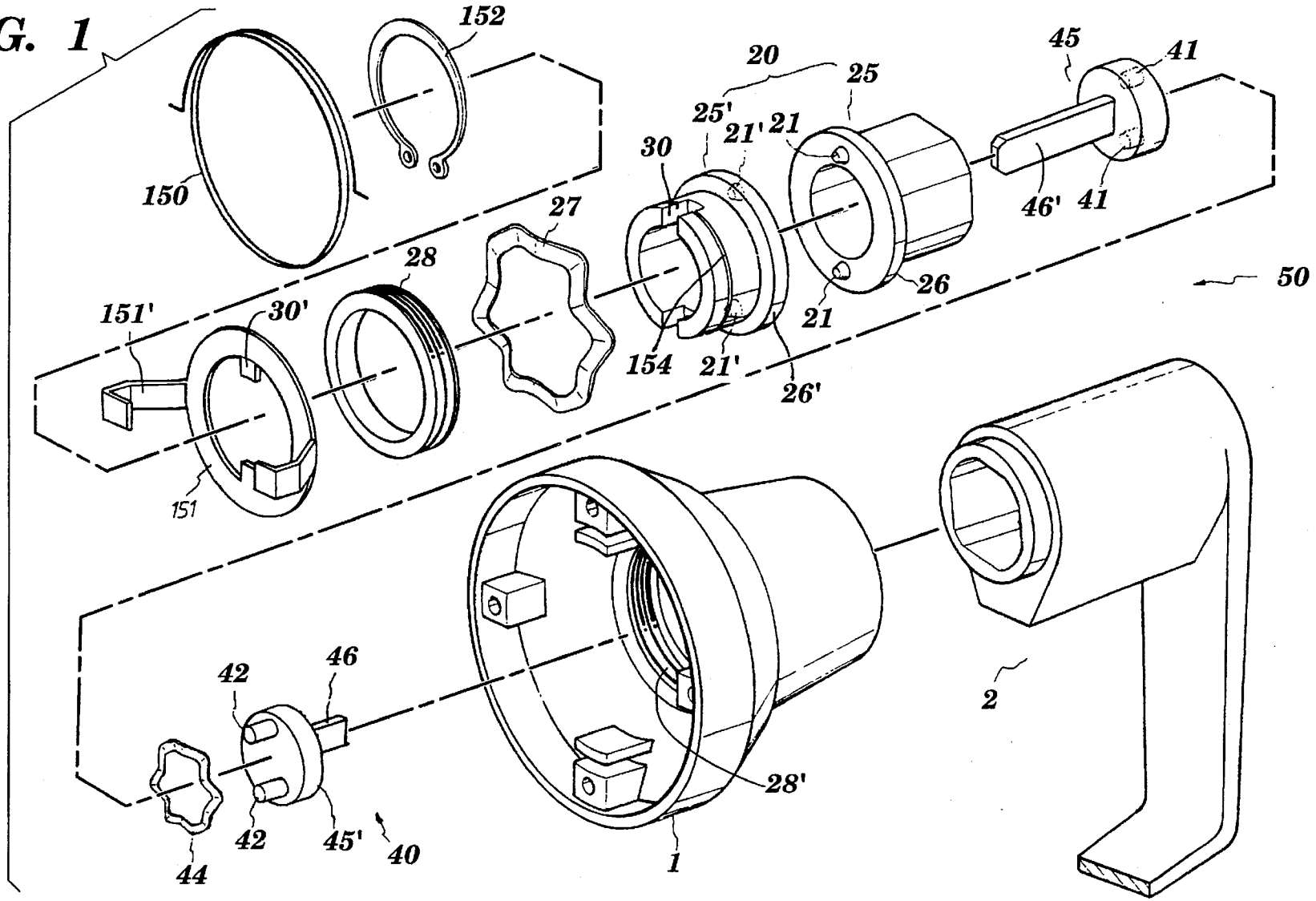
FIG. 1 is an exploded view of the door lock mechanism of the present invention.

Referring now specifically to the drawings, there is illustrated a door lock mechanism, generally designated as 50, wherein like reference numerals refer to like elements throughout the drawings.

Figure 2:
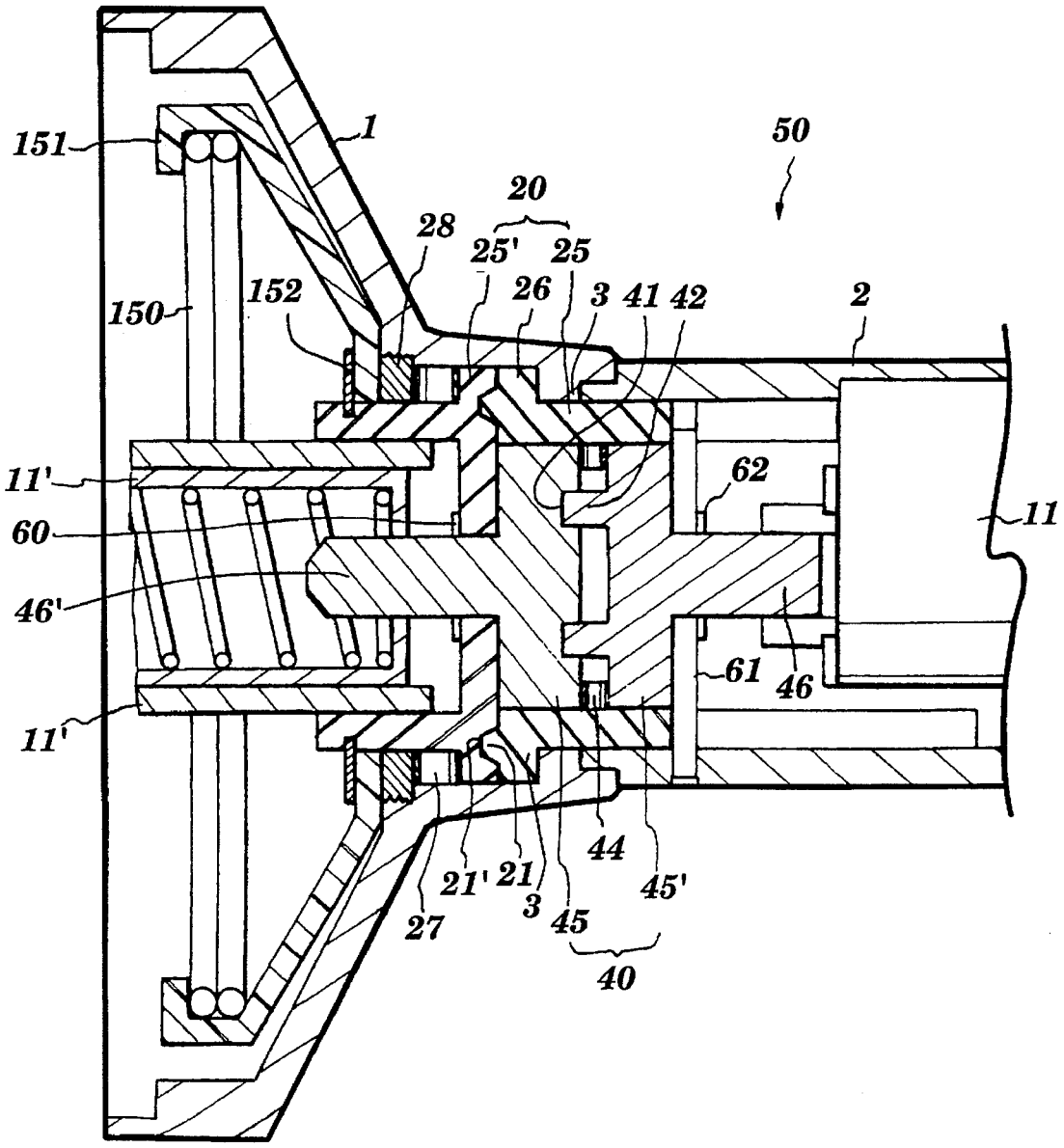
FIG. 2 is cross-sectional view of the door lock mechanism of the present invention in an at-rest position.
Figure 3:
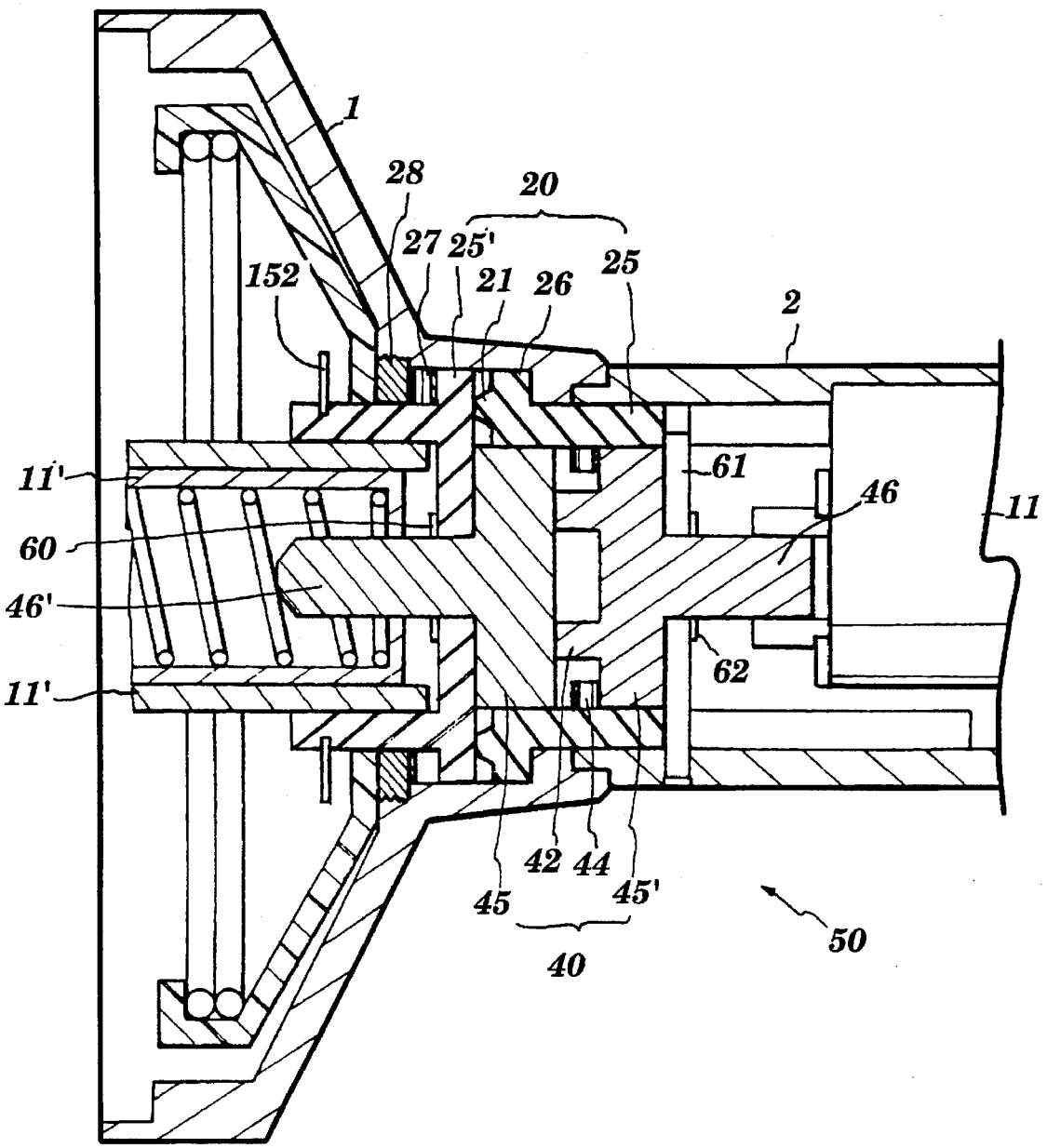
FIG. 3 is a cross-sectional view of the door lock mechanism of the present invention during the application of excessive force to the door lock external handle.

FIG. 1 shows an exploded perspective view of the door lock mechanism according to the present invention. FIGS. 2 and 3 are cross-sectional views showing the relationship of the inner lock body features. An outer housing 1 is attached at one end to a plate on the door itself, and on an opposite end to door handle/lever 2. Outer housing 1 is preferably bell-shaped and includes a threaded inner portion 28', located in its narrower end, proximate the door lever.

Positioned within the narrow end portion of outer housing 1 is a key connecting apparatus 40, comprised of an outer disc-shaped operator 45' and an inner disc-shaped operator 45. Outer operator 45' includes a connecting bar 46, extending from one of its faces, which is inserted into an aperture located in a key box 11 within lever 2. Retaining connecting bar 46 in a fixed axial position, while still being able to rotate freely, are lever stopper plate 61 and snap ring 62. Outer operator 45' further includes a plurality of pins 42 extending from an opposite face of said operator from said connecting bar 46. Preferably, pins 42 are trapezoidal-shaped such that they are narrower at the outer end than at the end affixed to outer operator 45'. Inner operator 45 includes a plurality of dints 41, shaped to receive pins 42 of outer operator 45'. Ring spring 44 is positioned between outer operator 45' and inner operator 45, to provide tensile movement between the two. Inner operator 45 further includes a bar 46' which extends from an opposite face of operator 45 from dints 41. Bar 46' extends outwardly to cooperate with key spindle 11' in a way that is known in the prior art.

Outer rose spindle assembly 20, comprised of an outer cylindrical spindle 25 and an inner cylindrical spindle 25' is located within housing 1 such that outer spindle 25 encompasses key operator assembly 40 and is connected to lever 2 proximate lever stopper plate 61. Outer spindle 25 includes a flange 26 having a plurality of outwardly extending pins 21, and inner spindle 25' includes a flange 26' having a plurality of inward dints 21', shaped to receive pins 21 of outer spindle 25. Preferably, pins 21 are trapezoidal-shaped and are narrower at the outer end than at the end affixed to outer spindle 25. Outer housing 1 includes an inwardly extruding ring 3, having a diameter smaller than that of range 26, such that as outer spindle 25 is inserted into outer housing 1, flange 26 abuts ring 3. Inner spindle 25' includes a plurality of slots 30 located in an end opposite to flange 26'.

Ring spring 27, preferably shaped as a zig-zag along its periphery, is placed over inner spindle 25'. Ring spring 27 provides for tensile movement of inner and outer spindles 25' and 25. Ring stopper 28 is threaded into the threaded inner portion 28' of outer housing 1, thus retaining rose spindle assembly 20 within the narrower end of outer housing 1. Slotted end 30 of inner spindle 25' extends through spring stopper 28, and into the wider portion of outer housing 1.

Ring-shaped spring holder 151 includes two inwardly-bent arms 151' which extend from the outer periphery of spring holder 151. Held within inwardly-bent arms 151' is spring 150. Spring 150 is wound such that it provides a returning force in an opposite direction to a force applied to lever 2, external to the lock mechanism. Spring holder 151 is attached over the portion of inner spindle 25' which extends outward from spring stopper 28. The inner periphery of spring holder 151 includes a plurality of inwardly extending tabs, which are received within slots 30 of inner spindle 25'. Lastly, stopper ring 152 is affixed to groove 154 of inner spindle 25' to secure spring holder 151 in position.

Now that one is familiar with the construction of the locking mechanism of the present invention, its mode of operation will be explained in detail.

Lock assembly 50 is first provided in its locked position, whereupon proper rotating force being applied to lever 2, the inner working features of lock assembly 50 will resist the force and be maintained in their position. However, upon the application of excessive force, the inner working features can be damaged, requiring repair or replacement of lock assembly 50.

The application of the present invention operates to prevent this excessive force from damaging the inner features of lock assembly 50. With proper force, pins 21 of outer spindle 25 will be maintained within dints 21' of inner spindle 25' and, as outer spindle 25 is thus fixed to inner spindle 25', inner spindle 25' will not rotate to open the door. However, upon the application of excessive force, pins 21 will be released from dints 21' and thus, the excessive force applied to lever 2 will only be transmitted as far as outer spindle 25. Ring spring 27, laid over inner spindle 25', provides tensile movement to outer rose spindle assembly 20 and thereby, absorbs the movement of pins 21.

Similarly, because key connecting operator assembly 40 is affixed within outer rose assembly 20, i.e., outer operator 45' is axially fixed to outer spindle 25 and inner operator 45 is axially fixed to inner spindle 25' by means of snap rings 62 and 60, respectively, as pins 21 of outer spindle 25 are released from dints 21' of inner spindle 25', so also are pins 42 of outer operator 45' released from dints 41 of inner operator 45. Ring spring 44 absorbs the movement of pins 42.

When the door is unlocked with a key, key cylinder 11 will rotate, together with outer operator 45' and inner operator 45 (with no relation to outer rose spindle assembly), which in turn rotates key spindle 11' and the door is opened.

The embodiments disclosed herein have been discussed for the purpose of familiarizing the reader with the novel aspects of the invention. Although preferred embodiments of the invention have been shown, many changes, modifications and substitutions may be made by one of ordinary skill in the art without necessarily departing from the spirit and scope of the invention as described in the following claims.

I claim:

1. A door lock having:

a handle having a hollow portion;

an outer open-ended cylindrical housing, having a threaded inner portion proximate one of its ends, affixed to said handle;

an outer spindle assembly within said housing proximate said end affixed to said handle, said outer spindle assembly comprised of:

an outer cylindrical spindle having a first end and a second end with a flange, and a plurality of outwardly extending pins extending from said flange;

an inner cylindrical spindle having a first end with a flange and a second end having a plurality of slots therein, and a plurality of inward dints in said flange, each dint shaped to receive one of said plurality of outwardly extending pins of said outer spindle;

wherein said first end of said outer spindle extends beyond said end of said outer housing affixed to said handle;

a key operating assembly comprised of:

a key spindle positioned within said hollow portion of said handle;

an outer operator having a connecting bar extending therefrom and a plurality of pins extending from said outer operator in a direction opposite to said connecting bar, and said connecting bar affixed to said key spindle;

an inner operator having a connecting bar extending from a surface thereof and a plurality of dints in a surface opposite of said connecting bar, each dint shaped to receive one of said plurality of pins of said outer operator;

a ring spring located between said outer operator and said inner operator;

wherein said key operating assembly is positioned within said outer spindle assembly such that said connecting bar of said outer operator extends outward from said outer spindle and is affixed to said key spindle and said connecting bar of said inner operator extends outward from said inner spindle;

a ring spring laid over said second end of said inner spindle to provide tensile movement for said outer and inner spindles;

a threaded ring stopper mounted on said second end of said inner spindle and threaded on said threaded portion of said housing;

a spring holder having a plurality of inwardly bent arms extending from an outer periphery of said spring holder and a plurality of tabs extending from an inner periphery of said spring holder, said spring holder mounted on said second end of said inner spindle whereby said tabs of said spring holder are received within said slots of said inner spindle;

a spring received within said inwardly bent arms of said spring holder;

a stopper ring mounted on said second end of said inner spindle, beyond said spring holder.

2. The door lock of claim 1 wherein said pins on said outer spindle are trapezoidal-shaped.

* * * * *